US008435427B2

(12) United States Patent
Ghosh et al.

(10) Patent No.: US 8,435,427 B2
(45) Date of Patent: May 7, 2013

(54) COMPOSITIONS HAVING NON-LINEAR CURRENT-VOLTAGE CHARACTERISTICS

(75) Inventors: Dipankar Ghosh, Oakdale, MN (US); Kenton D. Budd, Woodbury, MN (US); Nanayakkara L. D. Somasiri, Austin, TX (US); Ge Jiang, Cedar Park, TX (US); Bradley L. Givot, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 337 days.

(21) Appl. No.: 12/869,129

(22) Filed: Aug. 26, 2010

(65) Prior Publication Data

US 2012/0049135 A1 Mar. 1, 2012

(51) Int. Cl.
*H01B 1/02* (2006.01)

(52) U.S. Cl.
USPC ..... 252/519.12; 252/518.1; 361/1; 361/18; 361/30; 361/77; 523/200; 428/546

(58) Field of Classification Search ..... 252/518.1, 252/519.12; 361/1, 18, 30, 77; 523/200; 428/546
See application file for complete search history.

(56) References Cited

U.S. PATENT DOCUMENTS

| | | | | |
|---|---|---|---|---|
| 3,631,519 | A | 12/1971 | Salahsbourian | |
| 4,234,439 | A | 11/1980 | Kehr et al. | |
| 4,252,692 | A | 2/1981 | Taylor et al. | |
| 4,363,842 | A | 12/1982 | Nelson | |
| 4,470,898 | A | 9/1984 | Penneck et al. | |
| 4,681,717 | A | 7/1987 | Brooks | |
| 6,124,549 | A | 9/2000 | Kemp et al. | |
| 6,737,587 | B2 | 5/2004 | Amerpohl et al. | |
| 6,864,432 | B2 | 3/2005 | Boettcher et al. | |
| 7,170,004 | B2 | 1/2007 | Gramespacher et al. | |
| 2005/0218380 | A1 | 10/2005 | Gramespacher | |
| 2006/0133011 | A1 | 6/2006 | Cox | |
| 2007/0006435 | A1* | 1/2007 | Banerji et al. | 29/25.41 |
| 2007/0116976 | A1* | 5/2007 | Tan et al. | 428/546 |
| 2007/0117898 | A1 | 5/2007 | Tan et al. | |
| 2007/0272428 | A1 | 11/2007 | Bayon et al. | |
| 2009/0045544 | A1 | 2/2009 | Silvi | |
| 2010/0105806 | A1* | 4/2010 | Yang et al. | 523/201 |

FOREIGN PATENT DOCUMENTS

| | | |
|---|---|---|
| BR | 200704263 | 5/2009 |
| CN | 101234894 | 8/2008 |
| EP | 1585146 | 10/2005 |
| EP | 1790681 | 5/2007 |
| WO | WO 97/26693 | 7/1997 |
| WO | WO 2004/038735 | 5/2004 |
| WO | WO 2006/136040 | 12/2006 |

OTHER PUBLICATIONS

Barber, et al., "Polymer Composite and Nanocomposite Dielectric Materials for Pulse Power Energy Storage", Materials, 2009, vol. 2, pp. 1697-1733.

Marques, et al., "Evolution of CaCu3Ti4O12 varistor properties during heat treatment in vacuum", Ceramics International, 2007, vol. 33, pp. 1187-1190.

International Search Report for corresponding application No. PCT/US2011/047274, mailed Apr. 9, 2012.

Chung, et al., Strong nonlinear current-voltage behaviour in perovskite-derivative calcium copper titanate, Nature Materials, vol. 3, Nov. 2004.

Li et al., "Conduction properties of $CaCu_3Ti_4O_{12}$", Proceedings of 2008 International Symposium on Electrical Insulating Materials, Sep. 7-11, 2008, pp. 388-391.

Lin et al., "Grain boundary behavior in varistor-capacitor $TiO_2$-rich $CaCu_3Ti_4O_{12}$ ceramics", Journal of Applied Physics, vol. 103(7), 2008, pp. 074111-074111-5.

Moon et al., "Dielectric properties of epoxy-dielectrics-carbon black composite for phantom materials at radio frequencies", Journal of Applied Polymer Sciences, 77(2000) 1294-1302.

Preethi et al., "Colossal dielectric behavior of semiconducting $Sr_2TiMnO_6$ ceramics", Journal of Applied Physics, vol. 105, pp. 034113 (2009).

Tuncer et al., "Electrical properties of epoxy resin based nano-composites", Nanotechnology, 18 (2007).

Whangbo et al., "Structural Model of Planer Defects in $CaCu_3Ti_4O_{12}$ Exhibiting a Giant Dielectric Constant", Chem. Mater., 2006, 18, pp. 3257-3260.

* cited by examiner

*Primary Examiner* — Mark Kopec
*Assistant Examiner* — Haidung Nguyen
(74) *Attorney, Agent, or Firm* — Melanie G. Gover

(57) ABSTRACT

Provided are compositions and materials that have varistor properties and are suitable for use in electrical stress control devices and surge arrestor devices. The compositions and materials include a polymeric material and calcined calcium copper titanate filler material and have a reversible non-linear current-voltage characteristic.

16 Claims, 7 Drawing Sheets

COMPOSITIONS HAVING NON-LINEAR CURRENT-VOLTAGE CHARACTERISTICS

TECHNICAL FIELD

This invention relates to compositions having non-linear current-voltage characteristics and articles made therefrom.

BACKGROUND

Varistors, i.e., voltage-dependent resistors, display variable impedance, depending on the current flowing through the device or the voltage across it. The properties of varistor materials make them advantageous for uses such as electrical stress control devices and surge arrester, i.e., surge protection, devices.

Electrical stress control devices are used to contain and manage electrical stress, e.g., when shielded power cables are terminated or connected. When the insulation shield is removed from a cable, the electrical field is concentrated at the cutback point, causing high electrical stress. Electrical stress control is needed for such application of terminations or connecting cables.

Surge protection devices protect against surges generated by electromagnetic effects, such as lightning or electrostatic discharge caused by a variety of effects. As such, surge protection may be applied at the mains input to combat disturbances on the mains supply external to the operating equipment or internally generated overvoltages. A surge protector may either attenuate a transient by filtering or divert the transient to prevent damage to the load.

SUMMARY

One aspect of the present invention provides a composition comprising a polymeric material; and a calcined calcium copper titanate filler material; wherein the composition has a reversible non-linear current-voltage characteristic. The composition can be made into materials suitable for use in electrical stress control devices and surge arrester devices.

Another aspect of the present invention provides a method comprising providing calcium carbon titanate particles that have been calcined at about 1100° C. or above, combining the particles with a polymeric material to form a composition, and forming the composition into an article.

As used in this invention:

"Reversible non-linear current-voltage characteristic" refers to the current-voltage (I-V) behavior of the composition in an electric field that is lower than the irreversible breakdown field. Current-voltage behavior is sometimes also referred to as conductivity vs. electric field behavior.

An advantage of at least one embodiment of the present invention is that it provides a polymeric composition and material having both a high dielectric constant and non-linear current voltage characteristics.

Another advantage of at least one embodiment of the present invention is that the high non-linear coefficients of the varistor compositions allow them to pass widely varying currents over a much narrower voltage range than currently know varistor compositions.

Yet another advantage of at least one embodiment of the present invention is that the varistor compositions have both refractive (high dielectric constant) and resistive (high non-linear IV characteristic) electric field stress control.

The above summary of the present invention is not intended to describe each disclosed embodiment or every implementation of the present invention. The Figures and detailed description that follow below more particularly exemplify illustrative embodiments.

DETAILED DESCRIPTION

Figure 1:
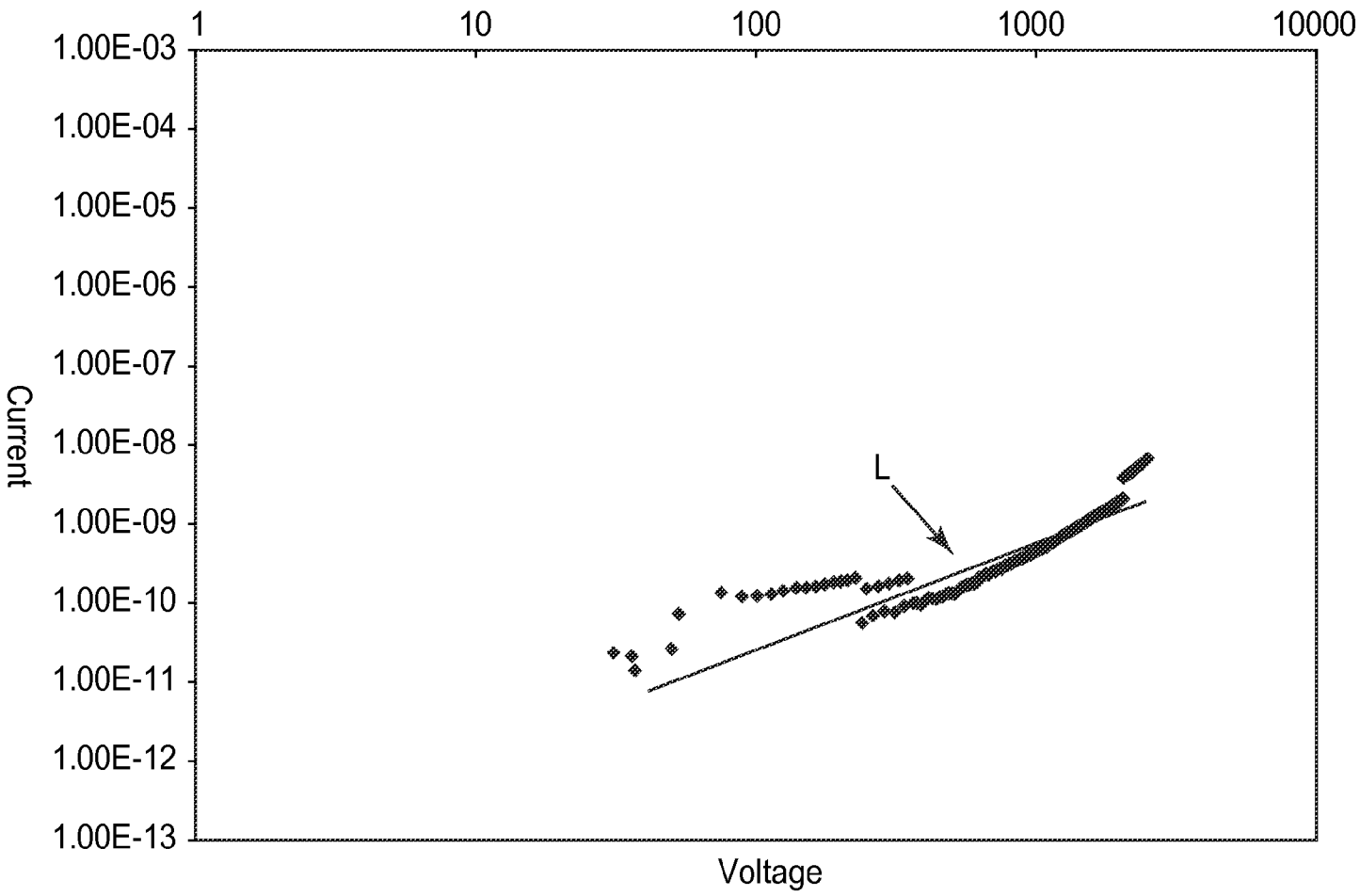
FIG. 1 depicts the linear current-voltage characteristics of a first comparative material.

In the following description, reference is made to the accompanying set of drawings that form a part of the description hereof and in which are shown by way of illustration several specific embodiments. It is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

In some aspects, the present invention relates to electrical stress control, and in particular to a composition of matter for effecting electrical stress control. The composition can be used in terminations and connectors for electrical power cables. In other aspects, the present invention relates to surge arresting, and in particular to a composition of matter for effecting surge arresting.

Electrical equipment, including power cables, operating at medium or high voltages, such as about 10 kV and above, can be subject to electrical stresses that may not be sufficiently controlled by a material that is essentially only electrically insulating. It is known to employ stress control material particularly for such applications. Such material may be classed as "linear" or as "non-linear." A linear stress control material obeys Ohm's law:

$$I=kV$$

where

I=current

V=voltage, and k is a constant.

A non-linear material obeys a generalized form of this equation $$I=kV^{\gamma}$$

where $\gamma$ (gamma) is a constant greater than 1, whose value depends on the material.

The inventors found that not only do the CCT particles of the present invention in the form of a pressed disk exhibit intrinsic non-linear I-V characteristics, also referred to herein as a "varistor effect," and further found that including these CCT particles in a polymer matrix imparted non-linear current-voltage (I-V) characteristics to the resulting composition. Accordingly, for the compositions of the present invention, the current can vary by orders of magnitude with only small changes in voltage. Prior to the present invention, it was not known if the inclusion of CCT particles having non-linear I-V characteristics would impart such similar characteristics to a polymeric matrix into which the particles were mixed.

The non-linear coefficient of the total composition of the present invention is preferably greater than about 100, more preferably greater than about 150, and most preferably greater than about 200. Currently known varistor materials such as doped ZnO and SiC have non-linear coefficients of about 20-90, which when used to make a composition, would result in a composition having a non-linear coefficient of about 10 to about 15. The much higher non-linear coefficient of compositions of the present invention allows it to pass widely varying currents over a much narrower voltage range than could be done with compositions containing currently known varistor materials.

Calcination as used herein means high temperature heating under gravity without any compression. The resulting material needs little force to be broken up, for example by light grinding. This minimizes the percentage of particles that have an irregular shape rather than the smooth, generically spherical, shape of the particles, which is the common shape of CCT powder as originally supplied by manufacturers. Calcination differs from sintering in that sintering typically includes heating, with the optional application of pressure, and subsequent quenching and typically results in the fusing of particles into a block of material. It has been shown that calcining plus sintering, or just sintering, of CCT particles in air can form dense pellets having non-linear current-voltage properties, but it was not known that CCT particles could be imparted with non-linear IV properties by calcination alone as was accomplished by the present inventors.

The calcination of the CCT particulate filler of the present invention takes place at about 1100° C. or above. The powder preferably is maintained at the calcination temperature for a sufficient time to ensure uniform electrical properties throughout all the particles. The inventors found that calcining at a temperature of 1000° C. or less did not produce the desired non-linear current-voltage characteristics in the CCT filler.

The calcination process is believed to result in the individual particles effectively exhibiting a "varistor effect." This means that the particles are non-linear with respect to variation of its D.C. electrical impedance characteristic (the relationship between the D.C. voltage applied to the particles and the resulting current flowing therethrough), but it also exhibits a transition in behavior in that the graph of voltage versus current shows a transition between linear and non-linear behavior.

The CCT of the present invention is preferably undoped. It has been shown that non-linear current-voltage properties can be imparted by calcining doped Zinc Oxide, but it was not known that undoped CCT particles could be imparted with non-linear IV properties by calcination. Other varistor materials, such as Zinc Oxide must be doped with materials such as $Bi_2O_3$, $Cr_2O_3$, $Sb_2O_3$, $CO_2O_3$, and $MnO_3$ to achieve a varistor effect, unlike the CCT of the present invention, which achieves a varistor effect without any doping. The CCT of the present invention can be n-type and p-type doped and will still retain its non-linear I-V characteristics.

The CCT powder comprises between about 25 vol % and about 45 vol % of the resulting material. In some embodiments, a preferred amount is about 30 vol %.

The polymeric matrix may comprise elastomeric materials, for example urethane, silicone, or EPDM; thermoplastic polymers, for example polyethylene or polypropylene; adhesives, for example those based on ethylene-vinyl-acetate or urethane; thermoplastic elastomers; gels; thermosetting materials, for example epoxy resins; or a combination of such materials, including co-polymers, for example a combination of polyisobutylene and amorphous polypropylene.

The total composition may also comprise other well-known additives for those materials, for example to improve their processibility and/or suitability for particular applications. In the latter respect, for example, materials for use as power cable accessories may need to withstand outdoor environmental conditions. Suitable additives may thus include processing agents, stabilizers, antioxidants and plasticizers, for example oil.

The dielectric constant of the total composition preferably is within the range of about 10 to about 40, preferably about 25. The dielectric constant preferably does not vary by more than 15% over a temperature range of 20-200° C. at a frequency of 1 kHz.

The loss tangent of the total composition is preferably about 0.02 or less, more preferably about 0.0168 or less at a frequency of 1 kHz.

The composition may be formed into a stress control layer such as a tape or a tube that can be applied around the equipment. The layer may also be provided as part of a co-extrusion, for example as an inner layer. The thickness of the layer can vary as needed, for example, depending on the electric field.

In accordance with another aspect of the present invention, there is provided electrical equipment, for example a connector or termination for an electric power cable, that includes a layer of material comprising the composition of the present invention, which material functions as a stress-control material.

The compositions and materials of the present invention are particularly suitable for use in electrical stress control applications because it has a reversible non-linear current-voltage characteristic. This is illustrated, for example, in FIG. 5, which shows the shapes of current-voltage curves in an electric field both as voltage increases (A) and as it decreases (B). The compositions of the present invention can be repeatedly exposed to increasing and decreasing voltages and will exhibit similar (though not necessarily identical) behaviors each time, as long as the voltage does not exceed the composition's or material's irreversible break-down field. When the compositions of the present invention are used in terminations, the terminations may be made shorter than conventional terminations and still provide the same level of performance. Alternately, they can be made the same length as conventional terminals and provide a higher level of performance. When the compositions of the present invention are used in splices, the splices may be made thinner than conventional splices and still provide the same level of performance. Alternately, they can be made the same thickness as conventional splices and provide a higher level of performance.

The compositions and materials of the present invention is also particularly suitable for use in voltage regulator applications, such as surge arresters, because of its reversible non-linear current-voltage characteristic. Surge arresters are over-voltage protection systems that have widespread use in power lines. Because the nonlinear I-V curve of the compositions and materials of the present invention are much steeper than that of commonly used varistors (e.g., doped ZnO, SiC, etc.) they can pass widely varying currents over a much narrower voltage range. The compositions and materials of the present invention can limit the voltage acting on them thus protecting equipment that is connected in parallel against a power surge or impermissibly high voltage stress thus acting as a surge arrester.

EXAMPLES

The following examples and comparative examples are offered to aid in the understanding of the present invention and are not to be construed as limiting the scope thereof. Unless otherwise indicated, all parts and percentages are by volume. The following test methods and protocols were employed in the evaluation of the illustrative and comparative examples that follow:

Material List

| Ingredient | Product Details | Source |
|---|---|---|
| Copper Oxide | 99% purity | Alfa Aesar, Ward Hill, MA |
| Calcium Titanate | 99% purity | Alfa Aesar, Ward Hill, MA |
| Titanium Dioxide | 99% purity | J. T. Baker, Phillipsburg, N.J. |
| Barium Titanate | 99% purity (nominal particle diameter of about 1 micrometer) | Ferro Corp., South Plainfield, N.J. |
| Liquid Silicone Rubber (LSR) | LR3003/30 | Wacker Chemie AG, Munich, Germany |
| Epoxy | Devcon 5-minute epoxy | Devcon, Danvers, MA |
| Release liner | 3M ™ Secondary Liner 4994 (3M ID 70-0000-4538-8) | 3M Company, St Paul, MN |

Test Methodologies

Test 1: Current Voltage (I-V) and Conductivity Characteristics.

The current-voltage (I-V) and conductivity characteristics of the CCT powder/polymer matrix compositions were determined using a Keithley 619 programmable electrometer fitted with a Keithley 247 High Voltage Power Supply Unit. The measurements were carried out using a step voltage ramp, where the current was measured at the end of each voltage step. All the measurements were done at room temperature.

Test 2: Dielectric Constant and Dissipation Factor Vs. Volume Fraction of Filler All measurements were done at room temperature using a Novocontrol GMBH Broadband Dielectric Spectrometer for frequencies between 1 Hz and 1 MHz.

Test 3: Temperature Dependence of Dielectric Constant (Dk) and Dissipation Factor (Df)

All measurements were done using a Novocontrol GMBH Broadband Spectrometer between 50° C. and 200° C. at a frequency of 1 KHz.

Example Preparation

Preparation Process 1: Calcium Copper Titanate, CaCu3Ti4O12(CCT), Powder

Stoichiometric quantities of high purity CuO (3 molar equivalents), $CaCO_3$ (1 molar equivalent) and $TiO_2$ (4 molar equivalents) powders were wet ball milled in distilled water in 500 ml Nalgene bottles using Yttria stabilized Zirconium oxide as the grinding media (5 mm beads available from Inframat Advanced Materials, CT) with the bottles being placed in a Jar Rolling Mill (available from Paul O Abbe Co.) for 24 hours to make a slurry. The slurry was dried in an oven at 100° C. for 3 hours and then calcined in a furnace at the temperatures shown in Table 1 for 10 hours. Both the heating and cooling rates during the calcination were constant at 10° C./minute. The resulting CCT powders were then sieved to a particle diameter size of about 200 μm and ground using a mortar and pestle to get the final powders. The phase purity of the final powder was confirmed by X-ray Diffraction (XRD).

Preparation Process 2: CCT Epoxy Compositions

The CCT Epoxy compositions were prepared by using Devcon 5-minute epoxy as the matrix polymer. The CCT powder was added to the epoxy in the amounts shown in Table 1 and mixed well by hand with a tongue depressor. The resulting composition was pressed into round discs of 1.00-2.00 mm thickness using a suitable spacer and a release liner, under a pressure of 4 tons. The pressed compositions were allowed to cool overnight.

Preparation Process 3: CCT Silicone Compositions

CCT Silicone composites were prepared by using ELECTROSIL LR3003/30 liquid silicone rubber as the matrix polymer. The CCT powder from Preparation Process 1 was ball milled for one hour using an 800M Mixer/Mill available from SPEX Sample Prep LLC. The powder was then dispersed in LSR in the amounts shown in Table 1 by first hand mixing with a spatula followed by spinning in a speed mixer (DAC 150FVZ available from FlackTech Inc.) at 3000 rpm for one minute. The resultant compositions contained 30 vol % CCT. The compositions were then transferred into a circular mold (2.54 mm in height and 3.175 cm in diameter) and pressed at 160° C. for 8 minutes. It was then removed from the mold and cured in a convection oven at 200° C. for 4 hours.

Preparation Process 4: BT Epoxy Compositions

The BT Epoxy compositions were prepared by using Devcon 5-minute epoxy as the matrix polymer. High purity Barium Titanate (99% purity, nominal particle diameter of about 1 micrometer, available from Ferro Corporation) was added in amounts shown in Table 3 to the epoxy and mixed well by hand with a tongue depressor. The resulting composition was pressed into round discs of 1.00-2.00 mm thickness using a suitable spacer and a release liner, under a pressure of 4 tons. The pressed compositions were allowed to cool overnight.

TABLE 1

Figure 2:
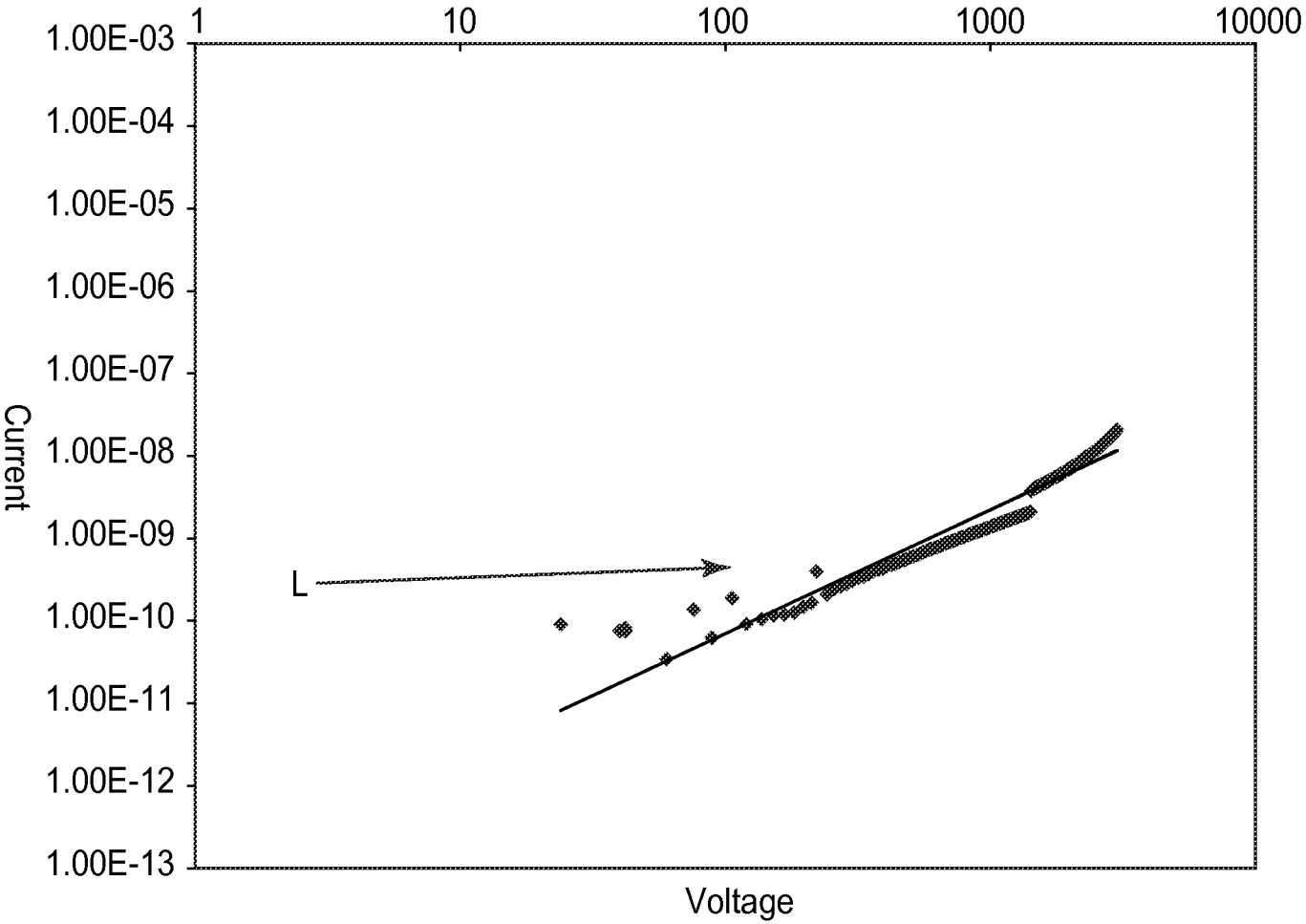
FIG. 2 depicts the linear current-voltage characteristics of a second comparative material.

| Ex. | Vol % Filler | Vol % Polymer | Calcination Temp of CCT (° C.) | Evaluation Method | Result |
|---|---|---|---|---|---|
| CE-A | 40 (CCT) | 60 (Epoxy) | 800 | Test 1 | FIG. 1 - showing linear (L) current voltage characteristics |
| CE-B | 40 (CCT) | 60 (Epoxy) | 1000 | Test 1 | FIG. 2 - Showing (L) linear current voltage characteristics |

TABLE 1-continued

Figure 3:
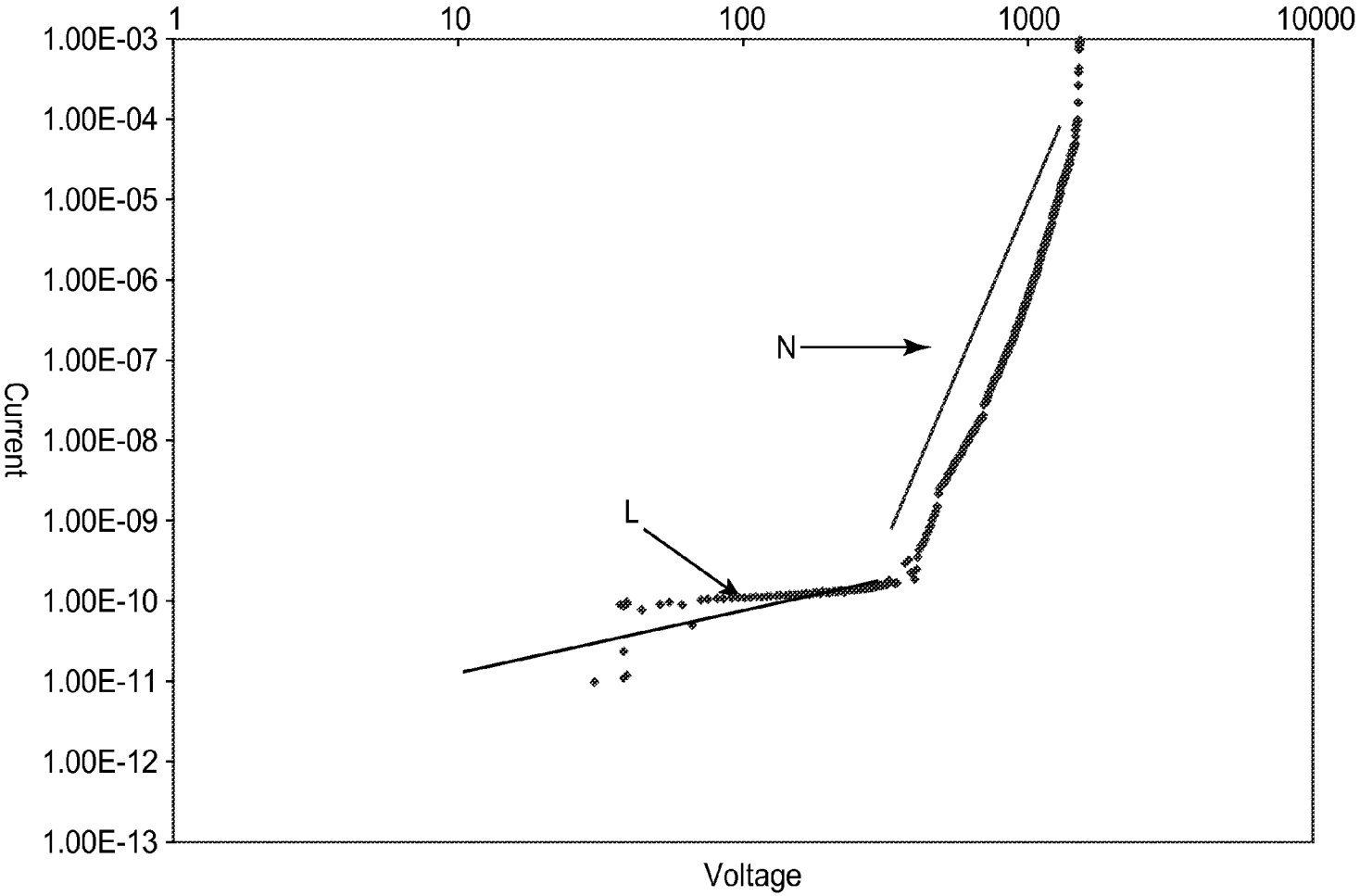
FIG. 3 depicts the non-linear current-voltage characteristics of an embodiment of the present invention.
Figure 4:
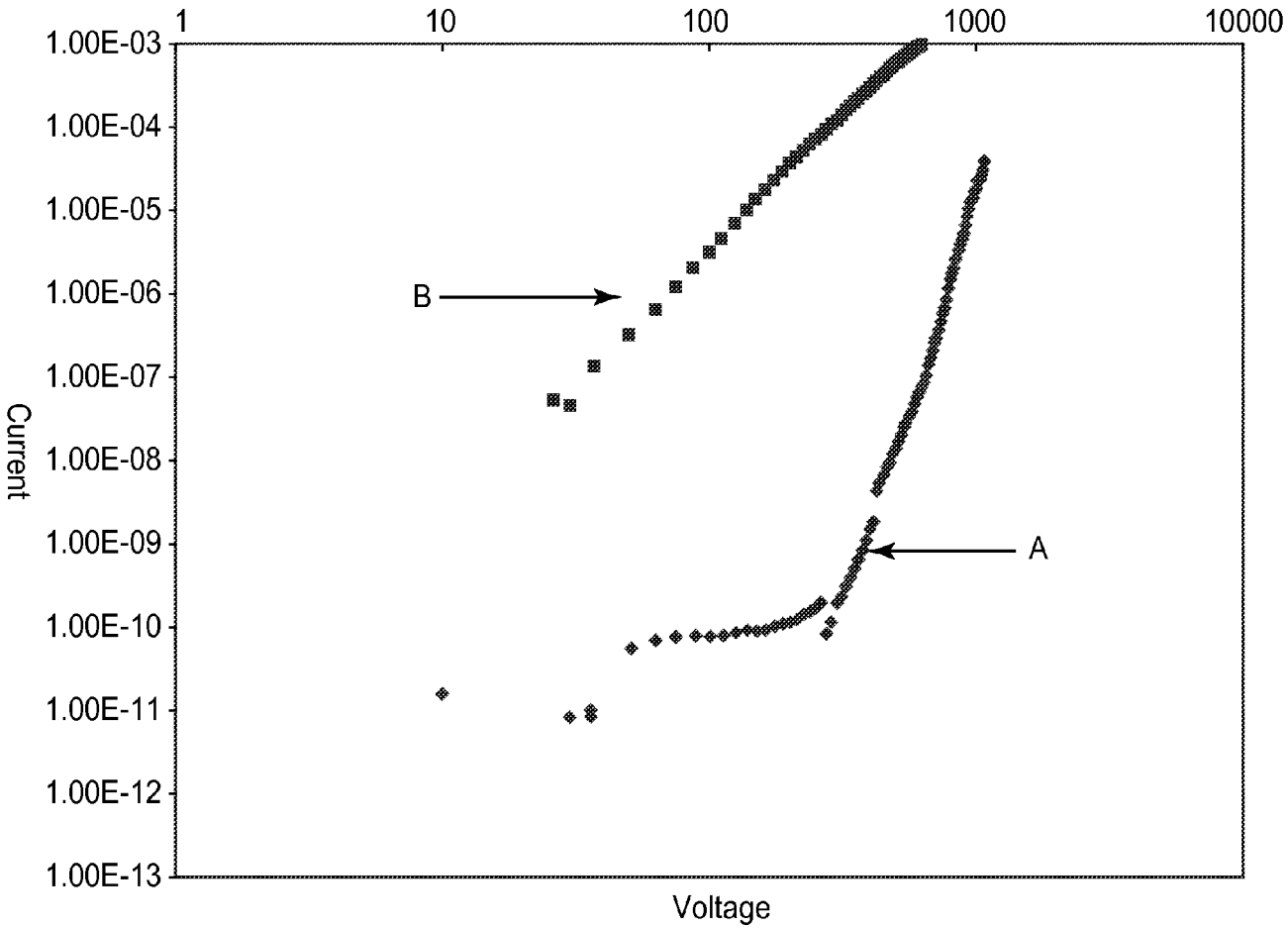
FIG. 4 depicts the reversible non-linear current-voltage characteristics of an embodiment of the present invention.
Figure 5:
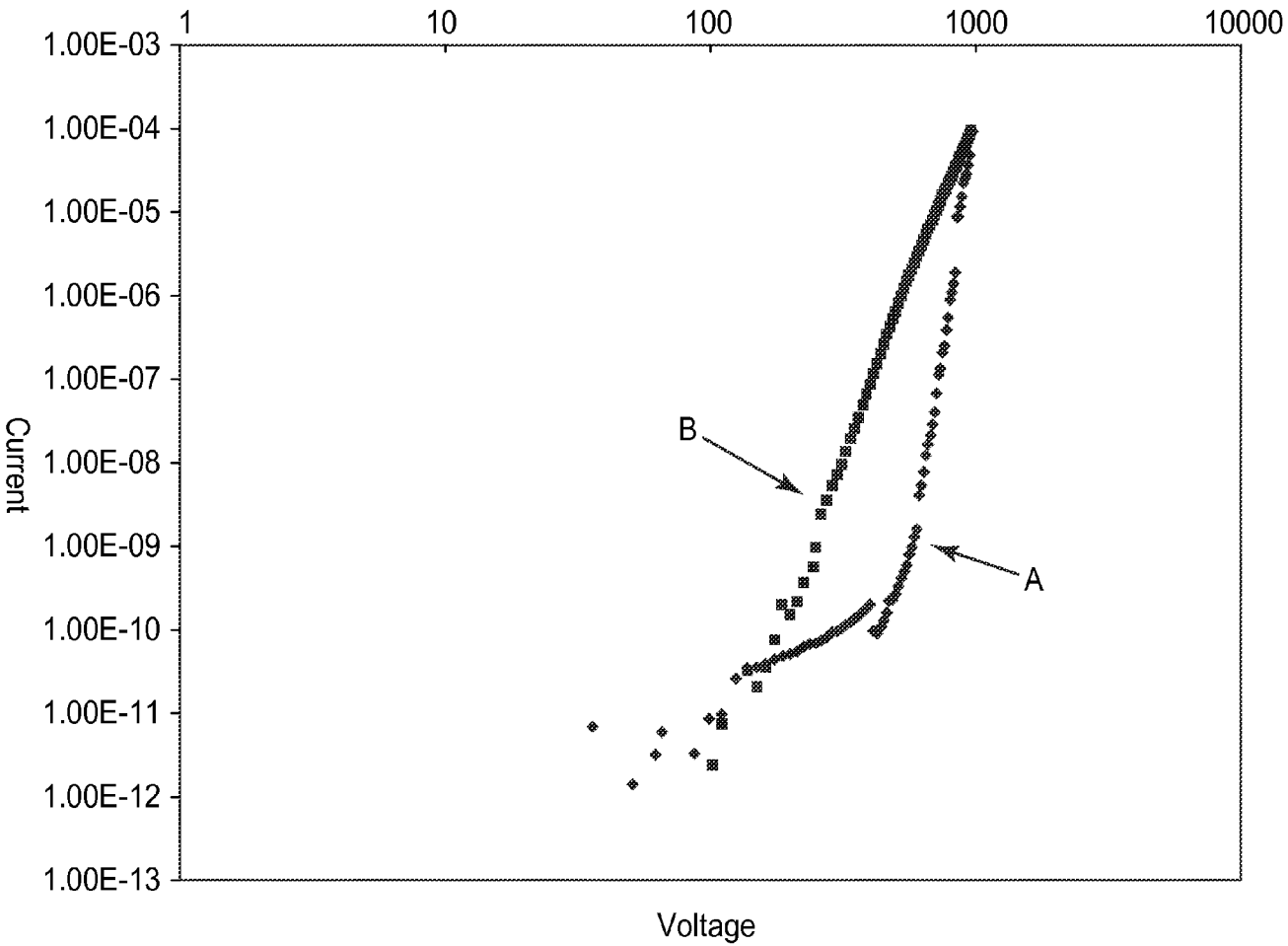
FIG. 5 depicts the reversible non-linear current-voltage characteristics of an embodiment of the present invention.
Figure 6A:
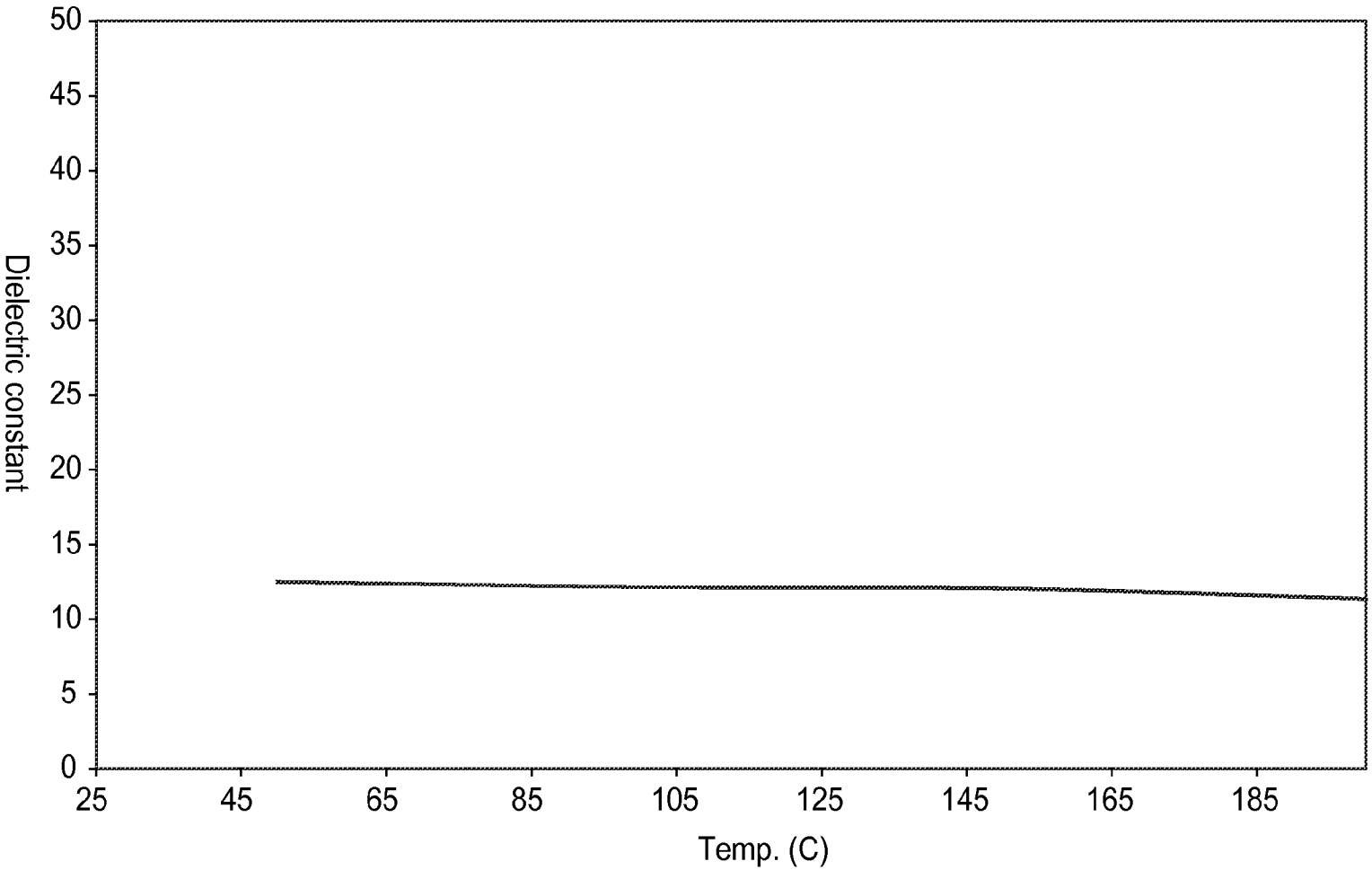
FIG. 6*a* depicts the dielectric constant of an embodiment of the present invention over a temperature range of about 50° C. to about 200° C.
Figure 6B:
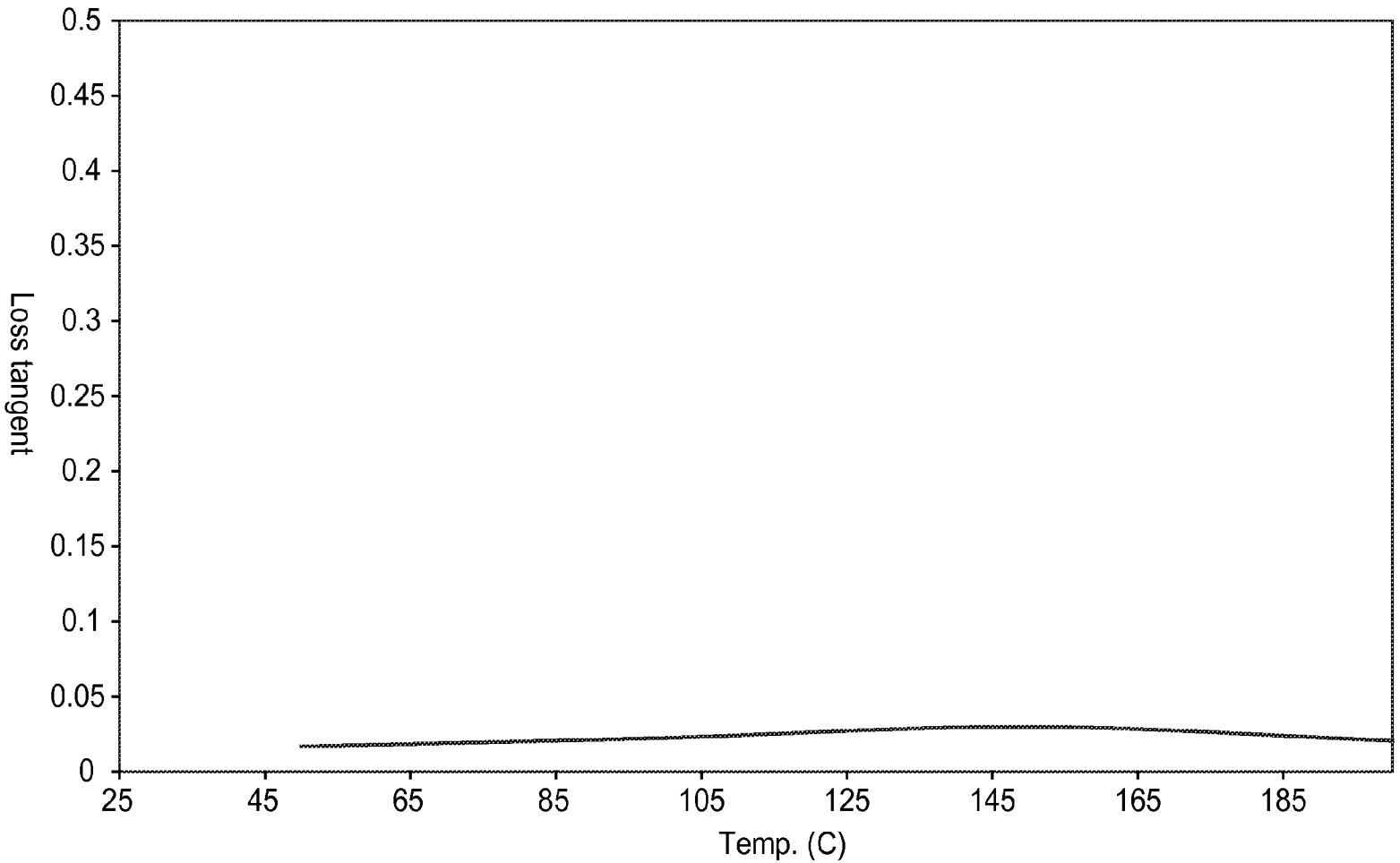
FIG. 6*b* depicts the loss tangent of an embodiment of the present invention over a temperature range of about 50° C. to about 200° C.

| Ex. | Vol % Filler | Vol % Polymer | Calcination Temp of CCT (° C.) | Evaluation Method | Result |
|---|---|---|---|---|---|
| 1 | 30 (CCT) | 70 (Epoxy) | 1100 | Test 1 | FIG. 3 - Showing linear (L) and nonlinear (N)current voltage characteristics |
| 2 | 30 (CCT) | 70 (Epoxy) | 1100 | Test 1 | FIG. 4 - Showing reversible and nonlinear current voltage characteristics as voltage increases (A) and as it decreases (B) |
| 3 | 30 (CCT) | 70 (LSR) | 1100 | Test 1 | FIG. 5 - Showing reversible and nonlinear current voltage characteristics as voltage increases (A) and as it decreases (B) |
| 4a-4d | 10-40 (CCT) | 90-60 (Epoxy) | 1100 | Test 2 | Table 2 |
| CE-Ca-CE-Cd | 10-40 (BT) | 90-60 (Epoxy) | N/A | Test 2 | Table 3 |
| 5 | 30 (CCT) | 70 (LSR) | 1100 | Test 3 | FIGS. 6a and 6b |

Comparative Examples A and B and Examples 1 to 3

Comparative Examples A and B and Examples 1 and 2 were made according to Preparation Processes 1 and 2. Example 3 was made according to Preparation Processes 1 and 3.

As shown by FIGS. 1 and 2, the comparative compositions having CCT that was calcined at 800 and 1000° C. have only linear I-V curves. In contrast, as shown in FIGS. 3 and 4-5, the compositions of the present invention having CCT that was calcined at 1100° C. have (reversible) non-linear, I-V curves.

Examples 4a-4-d and Comparative Examples Ca-Cd

Examples 4a-4-d were made according to Preparation Processes 1 and 2. The amounts of CCT and Epoxy for these examples and the dielectric constants of each composition are shown in Table 2, below. Comparative Examples Ca-Cd were made according to Preparation Process 4. The amounts of BT and Epoxy for these examples and the dielectric constants of each composition is shown in Table 3, below.

TABLE 2

| Ex. | Vol % CCT | Vol % Epoxy | Dielectric Constant @ 100 kHz |
|---|---|---|---|
| 4a | 10 | 90 | 8.52 |
| 4b | 20 | 80 | 12.5 |
| 4c | 30 | 70 | 23.9 |
| 4d | 40 | 60 | 31.2 |

TABLE 3

| Ex. | Vol % BT | Vol % Epoxy | Dielectric Constant @ 100 kHz |
|---|---|---|---|
| CE-Ca | 10 | 90 | 7.67 |
| CE-Cb | 20 | 80 | 11.9 |
| CE-Cc | 30 | 70 | 17.4 |
| CE-Cd | 40 | 60 | 24.8 |

As shown by a comparison of Tables 2 and 3 the CCT compositions of the present invention exhibit higher $D_k$ values than that of comparative BT compositions having the same filler loading levels.

Example 5

Example 5 was made according to Preparation Processes 1 and 3.

As shown by FIGS. 6*a* and 6*b*, the Dielectric Constant ($D_k$) and Loss Tangent of CCT compositions of the present invention do not vary by more than 15% over a temperature range of abut 50° C. to about 200° C.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. This application is intended to cover any adaptations or variations of the preferred embodiments discussed herein. Therefore, it is manifestly intended that this invention be limited only by the claims and the equivalents thereof.

What is claimed is:

1. A composition comprising:

a polymeric material; and a calcined calcium copper titanate filler material;

wherein the composition comprises between about 25 vol % and about 45 vol % of the filler material, and the composition has a reversible non-linear current-voltage characteristic.

2. The composition of claim 1 wherein the calcined calcium copper titanate filler material is unsintered.

3. The composition of claim 1 wherein the calcined calcium copper titanate filler material is undoped.

4. The composition of claim 1 having a dielectric constant between about 10 and about 40.

5. The composition of claim 1 wherein the calcium copper titanate filler is calcined at about 1100° C.

6. The composition of claim 1 having a dielectric constant varies less than 15% over a temperature range of about 20° C. to about 200° C. at a frequency of 1 kHz.

7. The composition of claim 1 having a loss tangent of about 0.02 or less at a frequency of 1 kHz at room temperature.

8. The composition of claim 1 having a non-linear coefficient (a) of greater than about 100.

9. The composition of claim 1 wherein the polymeric material is selected from the group consisting of silicone, epoxy, EPDM, urethane, and combinations thereof.

10. An article comprising the composition of claim 1.

11. The article of claim 10 wherein the article is a surge arrestor.

12. The article of claim 10 wherein the article is an electrical stress control article.

13. The article of claim 12 having a dielectric constant between about 10 and about 40.

14. The article of claim 12 wherein the article has a dielectric constant value of about 25.

15. The article of claim 10 wherein the article is a high voltage cable splice.

16. The article of claim 10 wherein the article is a high voltage termination.

* * * * *

UNITED STATES PATENT AND TRADEMARK OFFICE

CERTIFICATE OF CORRECTION

PATENT NO. : 8,435,427 B2
APPLICATION NO. : 12/869129
DATED : May 7, 2013
INVENTOR(S) : Dipankar Ghosh It is certified that error appears in the above-identified patent and that said Letters Patent is hereby corrected as shown below:

In the Specification:

Column 6
Line 37, delete "Flacktech" and insert -- FlackTek --, therefor.

Column 7
Line 34, delete "4a-4-d" and insert -- 4a-4d --, therefor.
Line 35, delete "4a-4-d" and insert -- 4a-4d --, therefor.

Column 8
Line 25, delete "abut" and insert -- about --, therefor.

In the Claims:

Line 61, in Claim 8, delete "(a)" and insert -- (α) --, therefor.

Signed and Sealed this
Tenth Day of September, 2013

Teresa Stanek Rea
*Acting Director of the United States Patent and Trademark Office*